US011364164B2

(12) United States Patent
Glikman et al.

(10) Patent No.: US 11,364,164 B2
(45) Date of Patent: Jun. 21, 2022

(54) TOILET WHEELCHAIR

(71) Applicants: Shay Glikman, Ness Ziona (IL); Izhak Rabinovitz, Gan Yavne (IL); Tal Glikman, Ness Ziona (IL)

(72) Inventors: Shay Glikman, Ness Ziona (IL); Izhak Rabinovitz, Gan Yavne (IL); Tal Glikman, Ness Ziona (IL)

( * ) Notice: Subject to any disclaimer, the term of this patent is extended or adjusted under 35 U.S.C. 154(b) by 0 days.

(21) Appl. No.: 17/258,356

(22) PCT Filed: Jul. 11, 2019

(86) PCT No.: PCT/IL2019/050779
§ 371 (c)(1),
(2) Date: Jan. 6, 2021

(87) PCT Pub. No.: WO2020/016882
PCT Pub. Date: Jan. 23, 2020

(65) Prior Publication Data

US 2021/0290459 A1 Sep. 23, 2021

Related U.S. Application Data

(60) Provisional application No. 62/698,162, filed on Jul. 15, 2018.

(51) Int. Cl.
*A61G 5/10* (2006.01)
*A47K 11/04* (2006.01)

(52) U.S. Cl.
CPC ..... *A61G 5/1002* (2013.01); *A47K 11/04* (2013.01); *A61G 5/1059* (2013.01)

(58) Field of Classification Search
CPC ..... A61G 5/1002; A61G 5/1059; A47K 11/04
(Continued)

(56) References Cited

U.S. PATENT DOCUMENTS 4,343,482 A * 8/1982 Wegner ..... A61G 5/1002 280/42
4,550,455 A * 11/1985 Carson ..... A61G 9/003 297/352

(Continued)

FOREIGN PATENT DOCUMENTS

CN 105012087 B 11/2015
CN 208096903 U 11/2018

(Continued)

OTHER PUBLICATIONS

PCT Search Report for International Application No. PCT/IL2019/050779 dated Oct. 23, 2019, 5 pp.

(Continued)

*Primary Examiner* — Huyen D Le
(74) *Attorney, Agent, or Firm* — The Roy Gross Law Firm, LLC; Roy Gross

(57) ABSTRACT

A toilet wheelchair comprises (a) a wheelchair frame; (b) at least three wheels rotatably connected to the wheelchair frame; and (c) a seat carried by the wheelchair frame; the seat comprises a main seat portion configured carrying a user and an auxiliary seat portion releasably mountable in an area configured for defecating the user. The wheelchair comprises a bag frame and a disposable bag carried by the frame; the toilet wheelchair comprises a lifting mechanism configured for displacing the seat from a transport position to an elevated position allowing the bag frame to be mountable within the area configured for toileting the user such that the bag is ready for receiving excrements of the user.

10 Claims, 12 Drawing Sheets

(58) Field of Classification Search
USPC ..... 4/480
See application file for complete search history.

(56) References Cited

U.S. PATENT DOCUMENTS

| | | | | |
|---|---|---|---|---|
| 5,820,152 | A * | 10/1998 | Warren-Pfaeffle | A61G 5/125 280/657 |
| 8,622,412 | B2 | 1/2014 | Pivato et al. | |
| 9,510,984 | B1 | 12/2016 | Mackenzie | |
| 2011/0277230 | A1 | 11/2011 | Williams | |
| 2012/0187663 | A1 | 7/2012 | Wilson | |
| 2015/0164717 | A1 | 6/2015 | Lee | |
| 2016/0038356 | A1* | 2/2016 | Yao | A61G 5/1002 280/304.1 |
| 2021/0085542 | A1* | 3/2021 | Mavhungu | A61G 5/1091 |
| 2021/0361500 | A1* | 11/2021 | Lai | A61G 5/0816 |

FOREIGN PATENT DOCUMENTS

| | | | |
|---|---|---|---|
| KR | 20060103126 | A | 9/2006 |
| WO | 2018178912 | A1 | 10/2018 |
| WO | 2020016882 | A1 | 1/2020 |

OTHER PUBLICATIONS

PCT Written Opinion for International Application No. PCT/IL2019/050779 dated Oct. 23, 2019, 4 pp.
Israel Patent Office, Application No. PCT/IL2019/050779, completed Oct. 23, 2019, 24 pp.
PCT Preliminary Report on Patentability for International Application No. PCT/IL2019/050779 completed Oct. 27, 2020, 24 pp.

* cited by examiner

TOILET WHEELCHAIR

This application is a National Phase of PCT Patent Application No. PCT/IL2019/050779 having International filing date of Jul. 11, 2019, which claims the benefit of priority of U.S. Provisional Patent Application No. 62/698,162, filed Jul. 15, 2018, the contents of which are all incorporated herein by reference in their entirety.

FIELD OF THE INVENTION

The present invention relates to toilet assistive devices and, more specifically, to a toilet wheelchair provided with a disposable bag for receiving excrements.

BACKGROUND OF THE INVENTION

The degree of disability of people who use wheelchairs varies considerably. For some of those who use wheelchairs being able to leave the wheelchair to deal with body functions is a relatively simple matter. For others, it is impossible. This invention provides a solution to the need for people who are wheelchair bound to be able to perform certain body functions with a relative degree of simplicity.

U.S. Pat. No. 8,622,412 discloses a wheelchair comprising a frame supported on wheels, a removable seat supported by the frame, a receptacle supported by the frame under the removable seat, a lifting tower supported by the frame and a sling carried by the lifting tower; and the sling being operable by the lifting tower through a lifting range to move between positions in which a person carried in the sling is raised above the removable seat so that the removable seat may be removed and a person carried in the sling is lowered to be supported over the receptacle.

Lifting the disabled person and mounting the removable seat is uncomfortable and traumatizing procedure. Hence, there is a long-felt and unmet need to provide a toilet wheelchair which allows toileting without displacement of the user from the wheelchair seat somewhere else.

SUMMARY OF THE INVENTION

It is hence one object of the invention to disclose a toilet wheelchair comprising: (a) a wheelchair frame; (b) at least three wheels rotatably connected to the wheelchair frame; (c) a seat carried by the wheelchair frame; the seat comprises a main seat portion configured carrying a user and an auxiliary seat portion releasably mountable in an area configured for toileting the user.

It is a core purpose of the invention to provide the toilet wheelchair comprising a bag frame and a disposable bag carried by the frame; the toilet wheelchair comprises a lifting mechanism configured for displacing the seat from a transport position to an elevated position allowing the bag frame to be mountable within the area configured for toileting the user such that the bag is ready for receiving excrements of the user.

Another object of the invention is to disclose the lifting mechanism comprising a hydraulic system having a main cylinder actuated by an electric motor and at least two slave cylinders hydraulically connected to each other; the at least two slave cylinders manipulate the seat.

A further object of the invention is to disclose the electric motor which is energized by a rechargeable electric battery.

A further object of the invention is to disclose at least two slave cylinders which are vertically oriented.

A further object of the invention is to disclose the bag frame slidably insertable into the area configured for defecating the user.

A further object of the invention is to disclose a method of assisting defecation of a user. The aforesaid method comprises steps of: (a) providing a toilet wheelchair further comprising: a wheelchair frame; (i) at least three wheels rotatably connected to the wheelchair frame; (ii) a seat carried by the wheelchair frame; the seat comprises a main seat portion configured carrying a user and an auxiliary seat portion releasably mountable in an area configured for toileting the user; the toilet wheelchair comprises a bag frame and a disposable bag carried by the frame; the toilet wheelchair comprises a lifting mechanism configured for displacing the main seat portion from a transport position to an elevated position allowing the bag frame to be mountable within the area configured for defecating the user such that the bag is ready for receiving excrements of the user; (b) placing the user onto the seat; (c) dismounting the auxiliary seat portion from the main seat portion; (d) displacing the main seat portion from a transport position to an elevated position; (e) mounting the bag frame and the disposable bag carried by the frame within the area configured for defecating the user; (f) dismounting the bag frame and the disposable bag after receiving the excrements thereinto; and (g) detaching the disposable bag from the bag frame.

A further object of the invention is to disclose the step of displacing main seat portion from a transport position to an elevated position performed by a lifting mechanism comprising a hydraulic system having a main cylinder actuated by an electric motor and at least two slave cylinders hydraulically connected to each other; the at least two slave cylinders manipulate the seat.

BRIEF DESCRIPTION OF THE DRAWINGS

In order to understand the invention and to see how it may be implemented in practice, a plurality of embodiments is adapted to now be described, by way of non-limiting example only, with reference to the accompanying drawings, in which.

DETAILED DESCRIPTION OF THE INVENTION

The following description is provided, so as to enable any person skilled in the art to make use of said invention and sets forth the best modes contemplated by the inventor of carrying out this invention. Various modifications, however, are adapted to remain apparent to those skilled in the art, since the generic principles of the present invention have been defined specifically to provide a toilet wheelchair and a method of assisting user's toileting.

Figure 1A:
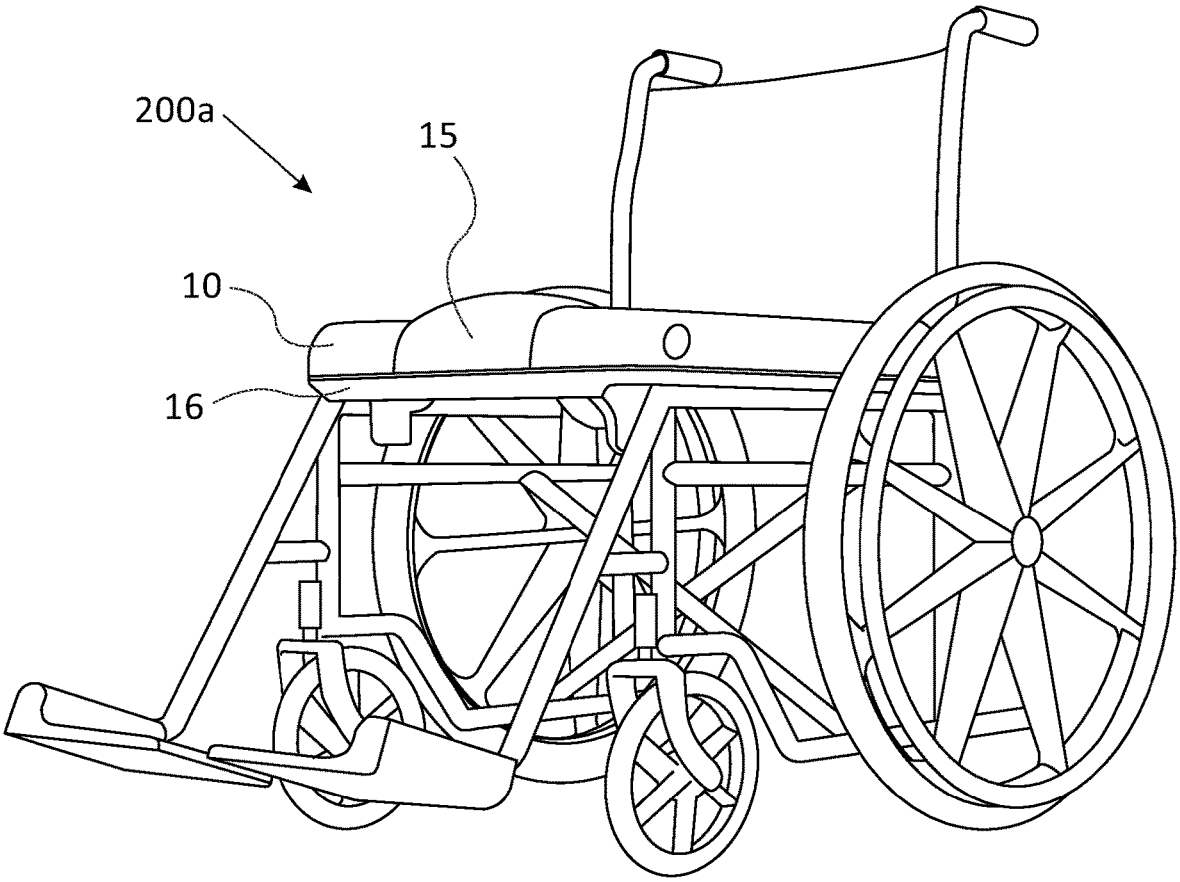
FIGS. 1*a* and 1*b* are general perspective views of a toilet wheel chair in transport and elevated positions, respectively.
Figure 1B:
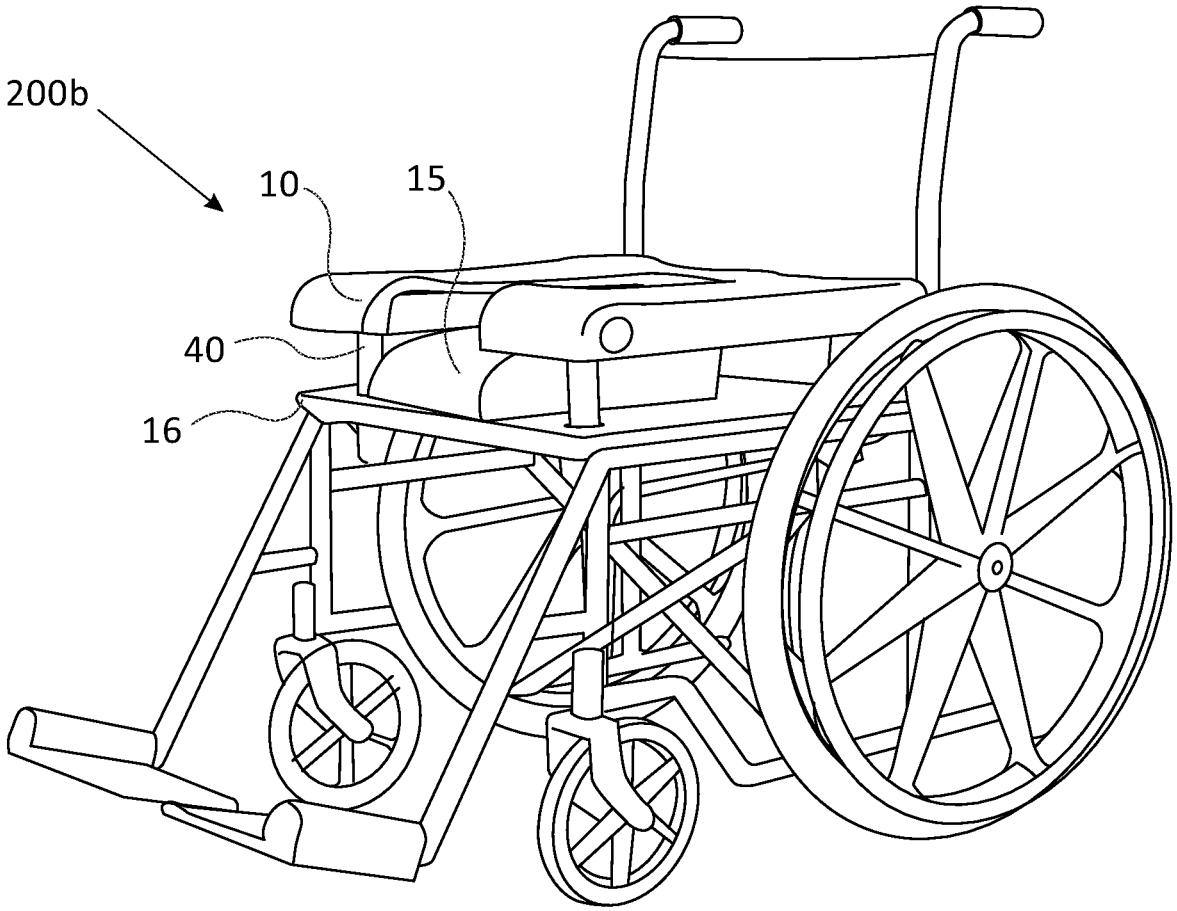

Reference is now made to FIGS. 1*a* and 1*b* presenting general perspective views of a toilet wheel chair in transport and elevated positions, respectively. FIG. 1*a* shows the toilet wheelchair 200*a* in a transport position. Main seat 10 and auxiliary portion 15 are supported by base member 16. In FIG. 1*b*, main seat 10 is lifted into an elevated position by hydraulic cylinders 40. Auxiliary portion 15 is disengaged from main seat 10.

Figure 2:
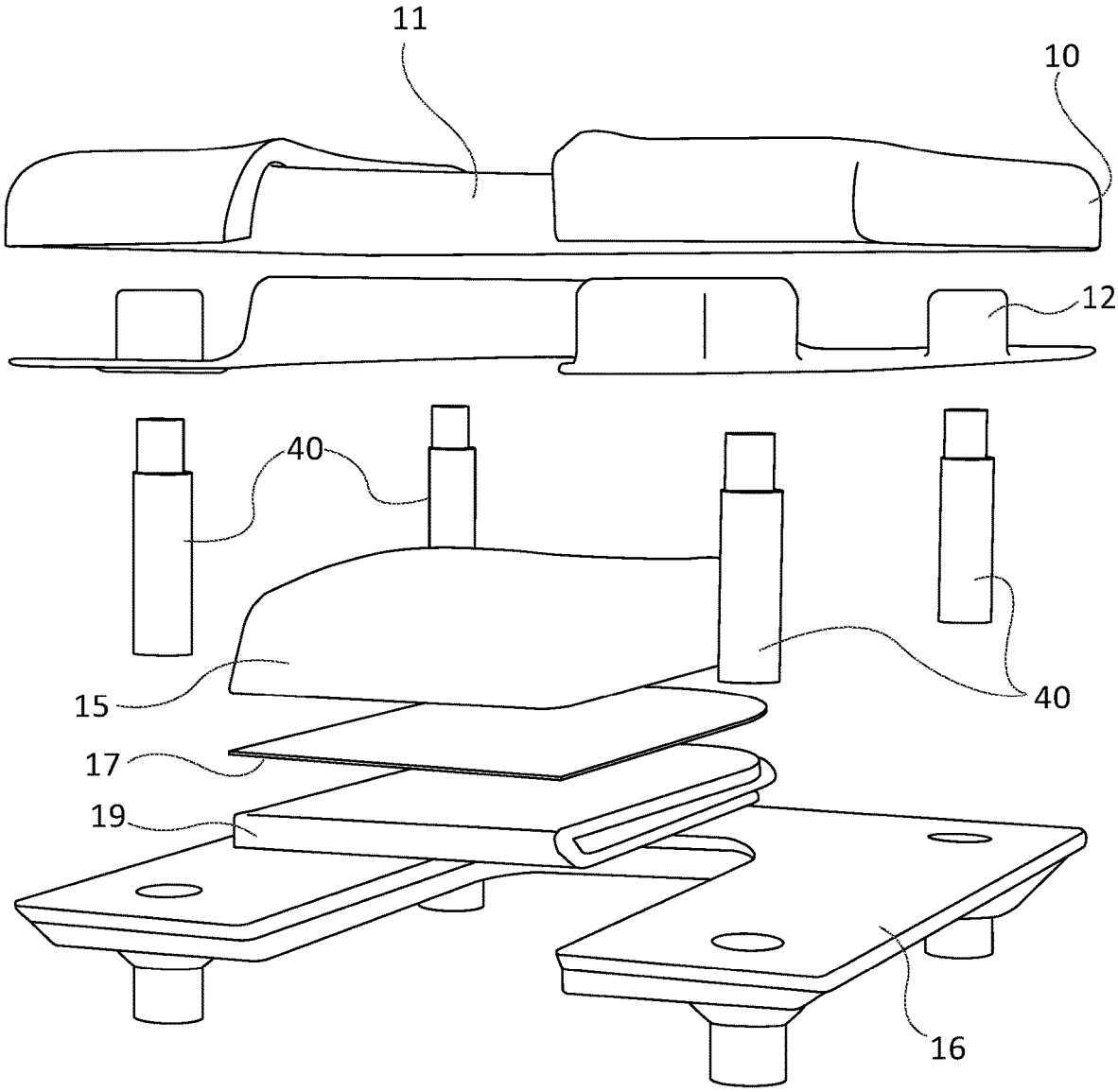
FIG. 2 is a perspective view of a seat arrangement.

Reference is now made to FIG. 2 presenting seat arrangement in detail. Base member 16 is mechanically connected to a frame of the toilet wheelchair (not shown). Hydraulic cylinders 40 are configured for lifting main seat arrangement including bearing member 12 and main seat 10 per se. Auxiliary seat portion arrangement includes bearing member 19, interlayer 17 and auxiliary seat portion 15 per se. Auxiliary seat portion arrangement 15-17-19 is mountable into recess 11 in order to create an integral comfortable surface of a seat.

Figure 3:
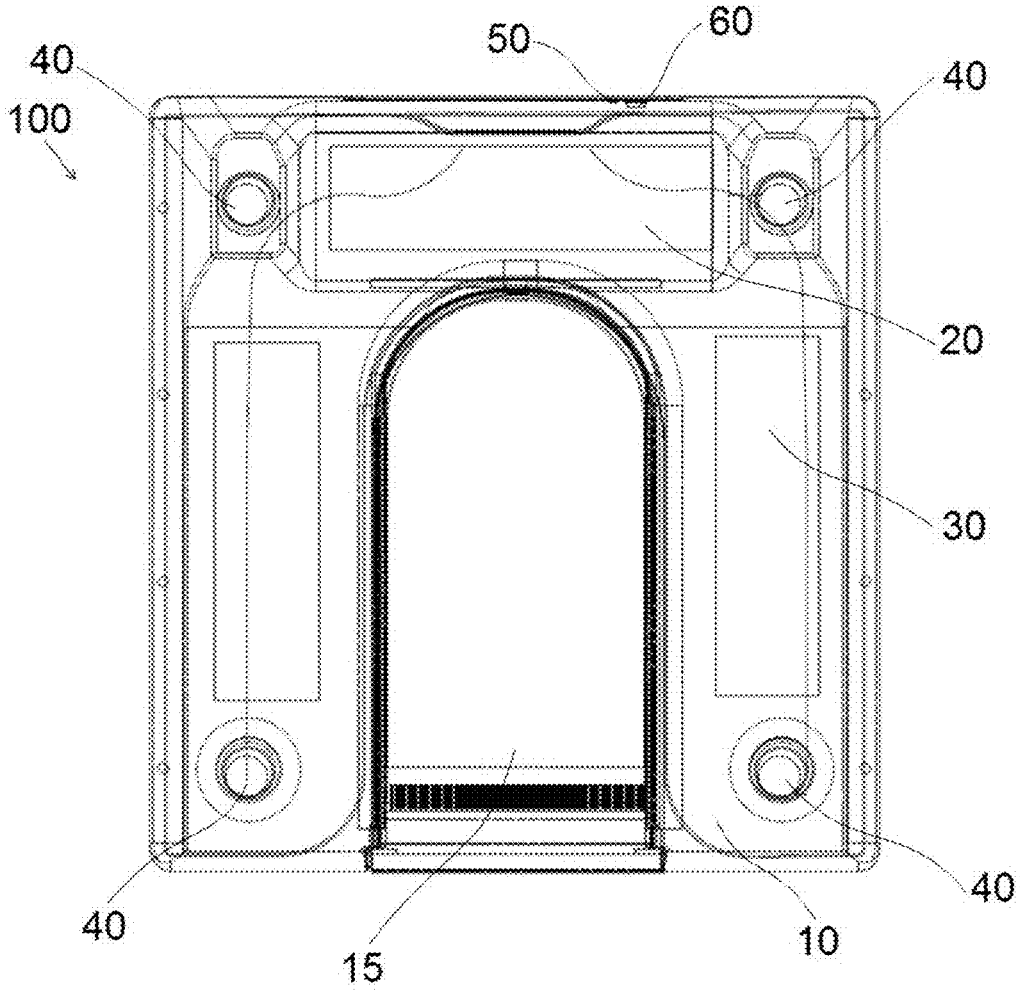
FIG. 3 is a top view of a seat arrangement.

Reference is now made to FIG. 3 presenting a top view of seat arrangement 100. Specifically, main seat 10 and auxiliary seat portion 15 create an integral seat. Main seat 10 is liftable by a hydraulic system including main cylinder 20 driven by an electric motor (not shown) and slave cylinders 40 interconnected by pipes conducting working body (not shown). Electric rechargeable battery 30 energizes the electric motor. Numerals 50 and 60 refers to an indicator lamp and an electric connector for recharging battery 30.

Figure 4A:
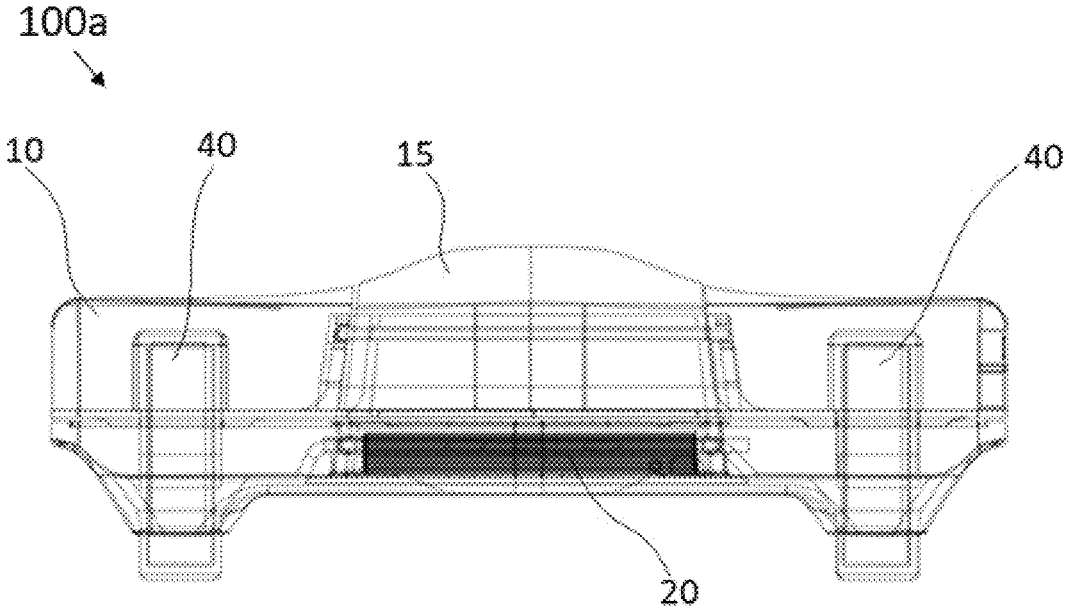
FIGS. 4*a* and 4*b* are front views of a seat arrangement in transport and elevated positions.
Figure 4B:
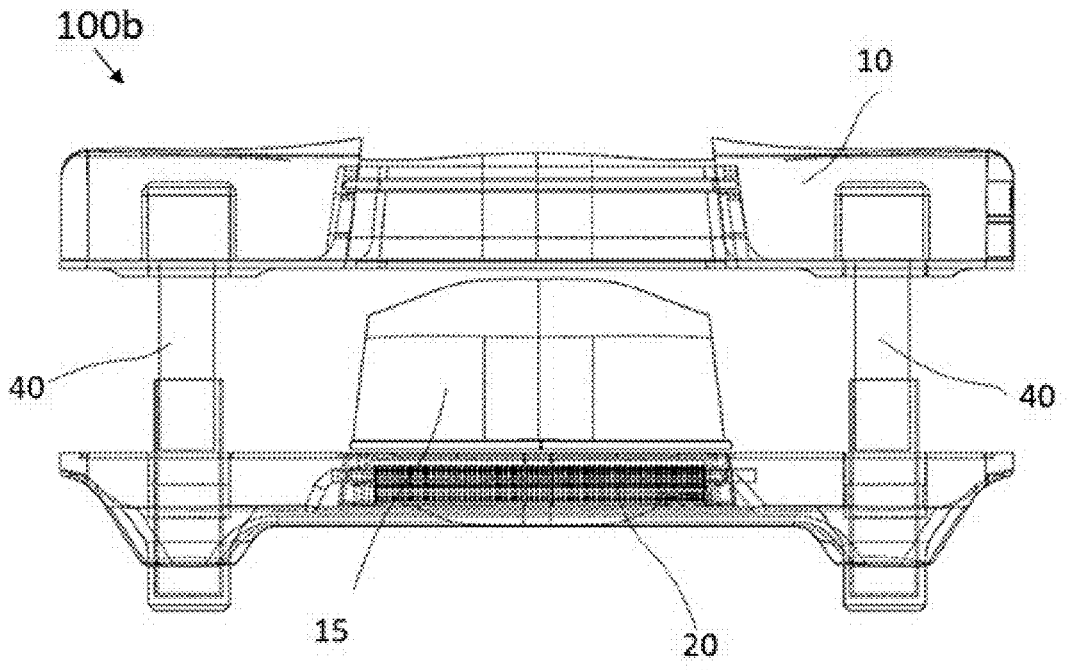
Figure 5A:
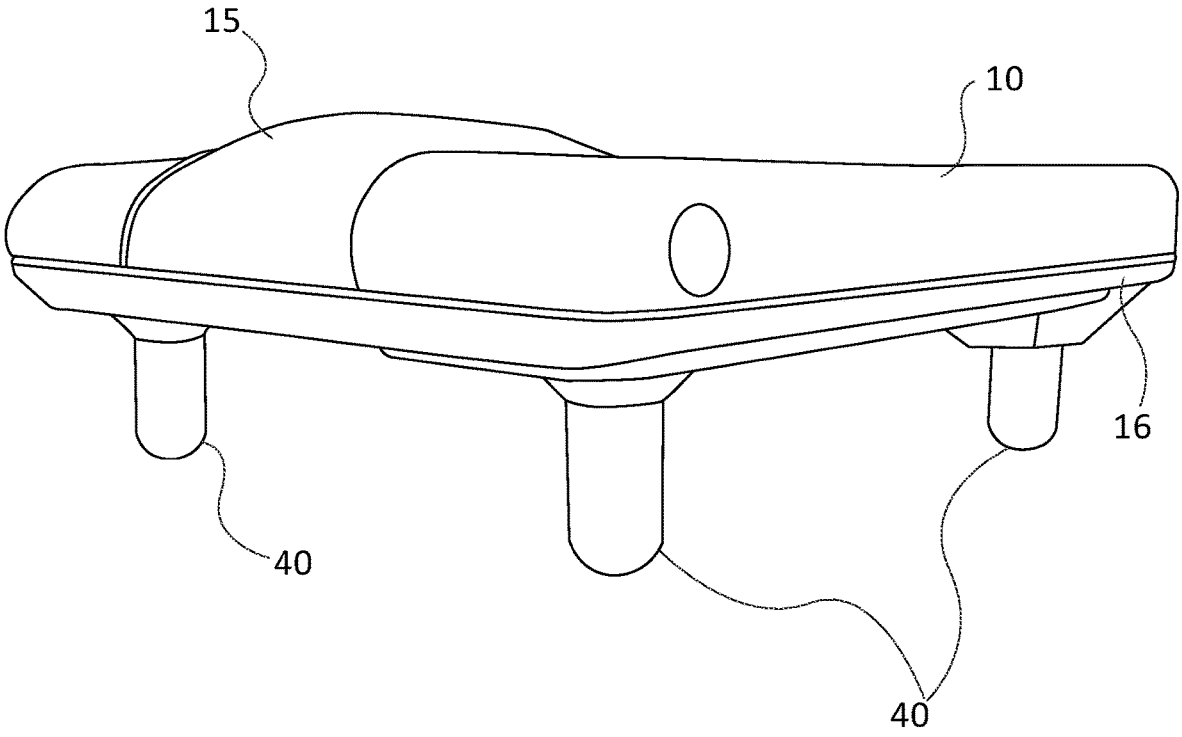
FIGS. 5*a* to 5*d* illustrate dismounting an auxiliary portion from a main seat.
Figure 5B:
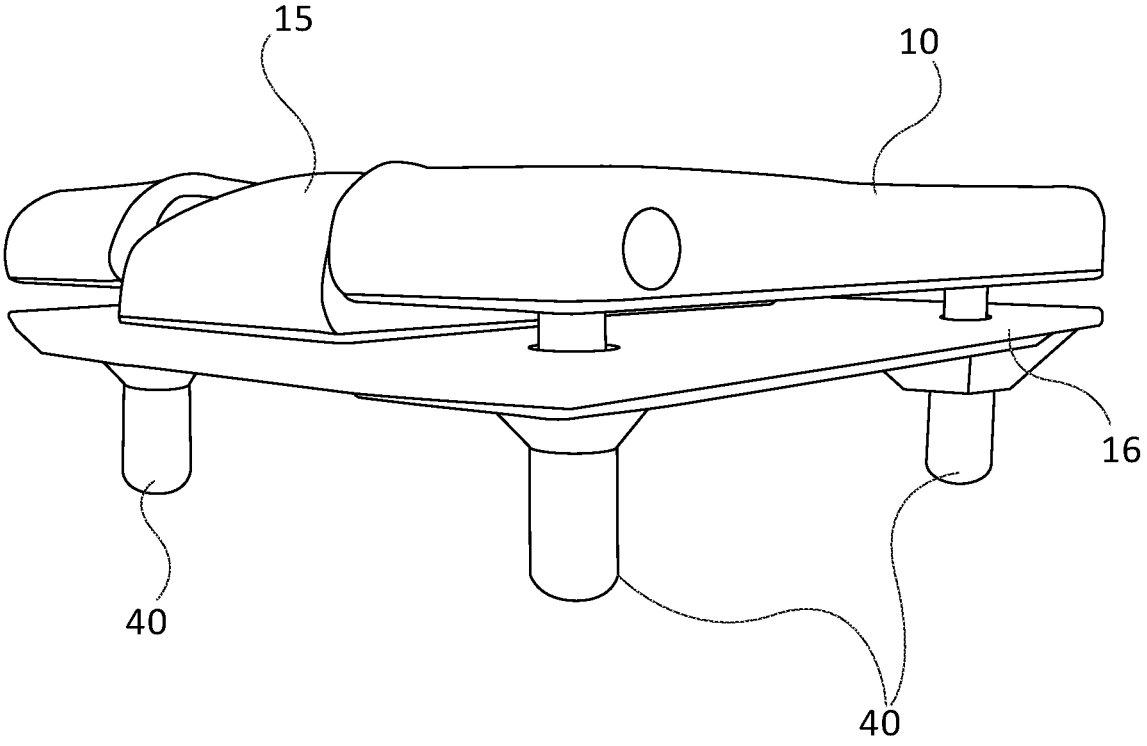
Figure 5C:
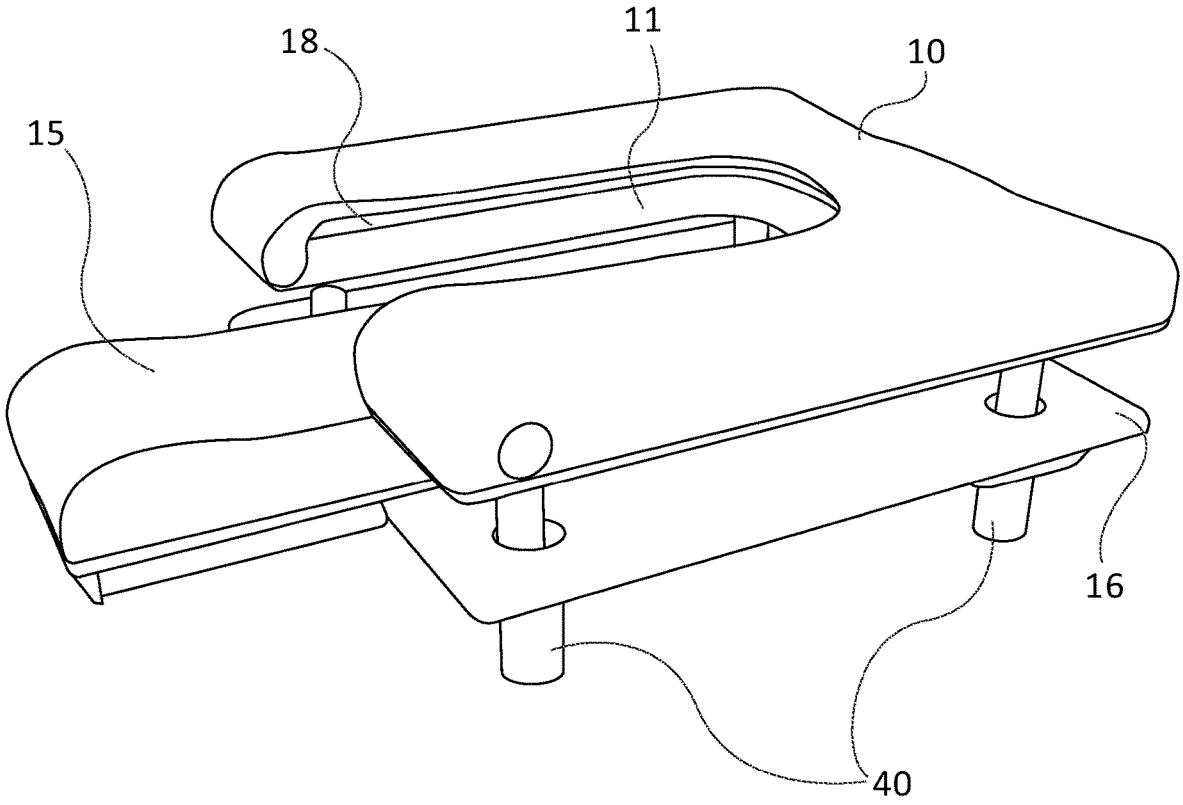
Figure 5D:
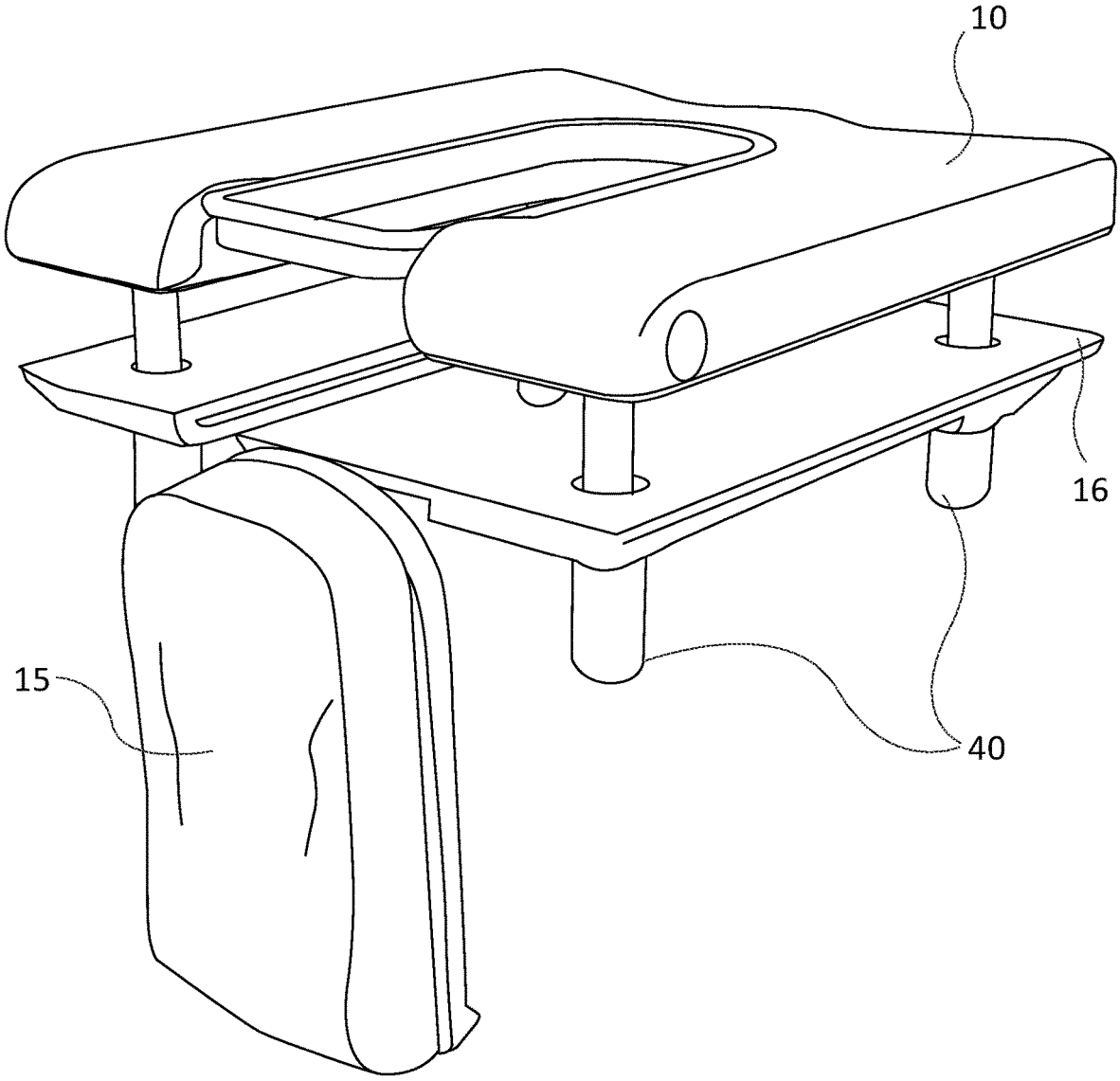

Reference is now made to FIGS. 4*a* and 4*b* presenting the seat arrangement in transport position 100*a* and elevated position 100*b*, respectively. Elevating main seat 10 is performed by slave cylinders 40 fed by the working body delivered by main cylinder 20.

Reference is now FIGS. 5*a* to 5*d* illustrating a procedure of dismounting auxiliary portion 15 from a main seat and mounting bag frame 70. Specifically, recess 11 has channel 18 configured for securing auxiliary portion 15 and bag frame 70. Before toileting, auxiliary portion 15 is replaced with bag frame 70 carrying a disposable bag (not shown).

Figure 6A:
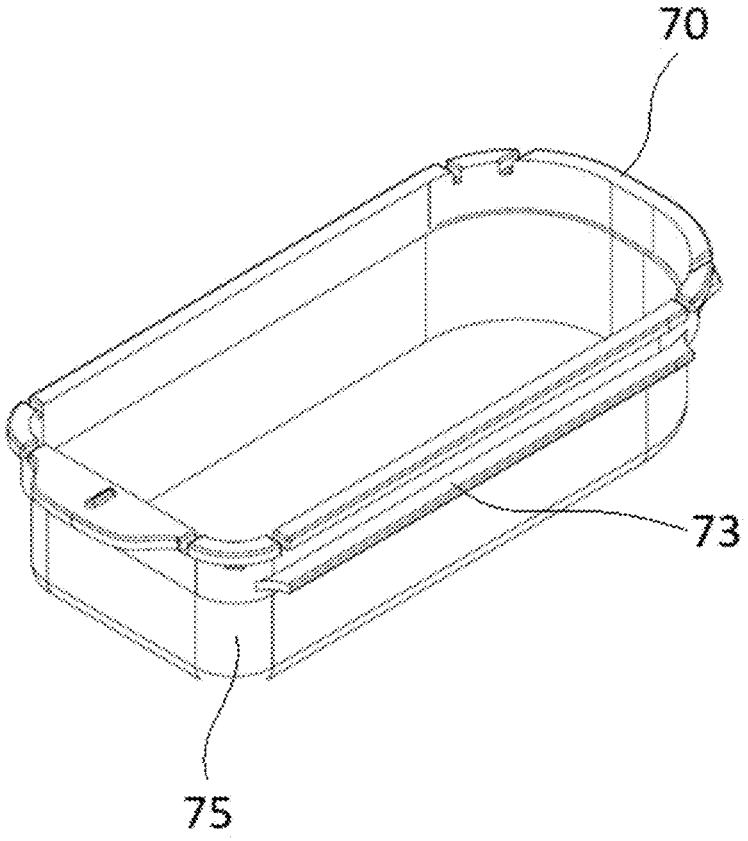
FIGS. 6*a* and 6*b* are perspective views of a bag carried by a frame in dismounted and mounted positions, respectively.
Figure 6B:
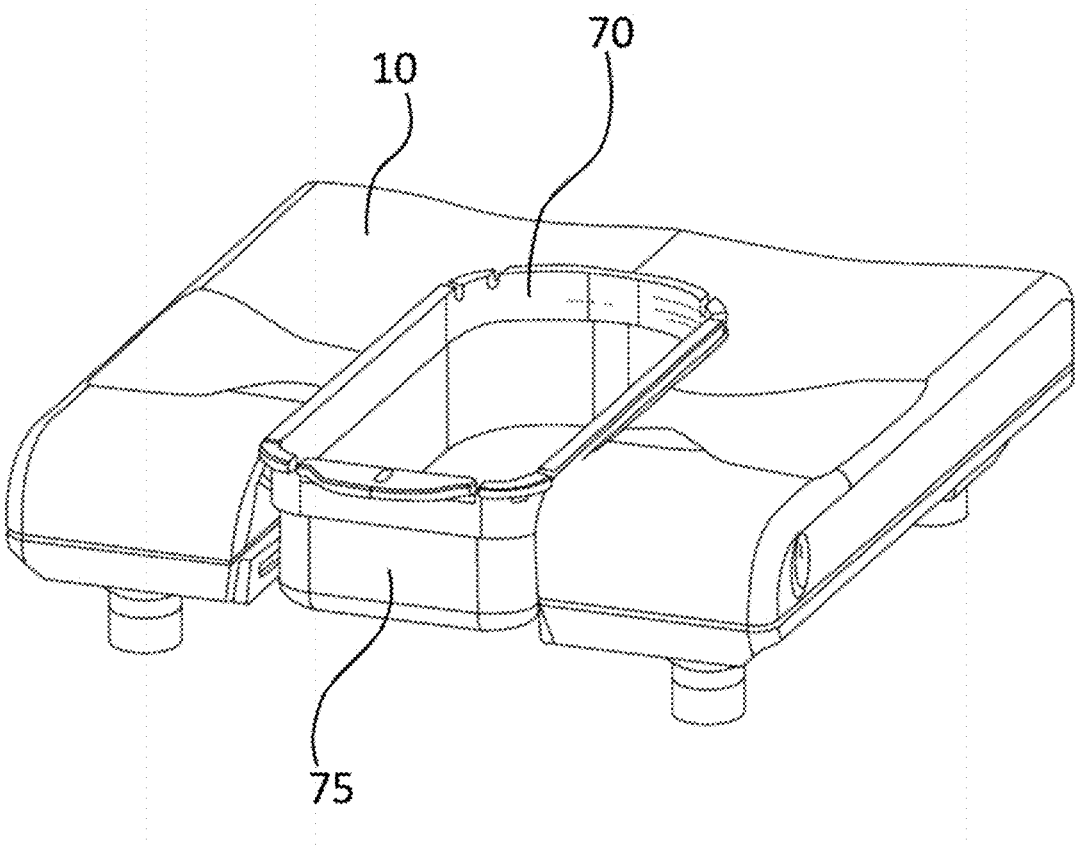

Reference is now FIGS. 6*a* and 6*b* presenting perspective views of bag 75 carried by bag frame 70 in dismounted and mounted positions, respectively. Bag frame 70 is provided with projection 73 configured to be received by channel 18 (not shown) such that bag frame 70 is secured within recess 11.

According to the present invention, a toilet wheelchair comprising: (a) a wheelchair frame; (b) at least three wheels rotatably connected to the wheelchair frame; (c) a seat carried by the wheelchair frame; the seat comprises a main seat portion configured carrying a user and an auxiliary seat portion releasably mountable in an area configured for toileting the user.

It is a core feature of the invention to provide the toilet wheelchair comprising a bag frame and a disposable bag carried by the frame; the toilet wheelchair comprises a lifting mechanism configured for displacing the seat from a transport position to an elevated position allowing the bag frame to be mountable within the area configured for toileting the user such that the bag is ready for receiving excrements of the user.

According to one embodiment of the present invention, the lifting mechanism comprises a hydraulic system having a main cylinder actuated by an electric motor and at least two slave cylinders hydraulically connected to each other; the at least two slave cylinders manipulate the seat.

According to one embodiment of the present invention, the electric motor which is energized by a rechargeable electric battery.

According to a further embodiment of the present invention, at least two slave cylinders are vertically oriented.

According to a further embodiment of the present invention, the bag frame slidably is insertable into the area configured for defecating the user.

According to a further embodiment of the present invention, a method of assisting defecation of a user is disclosed. The aforesaid method comprises steps of: (a) providing a toilet wheelchair further comprising: a wheelchair frame; (i) at least three wheels rotatably connected to the wheelchair frame; (ii) a seat carried by the wheelchair frame; the seat comprises a main seat portion configured carrying a user and an auxiliary seat portion releasably mountable in an area configured for toileting the user; the toilet wheelchair comprises a bag frame and a disposable bag carried by the frame; the toilet wheelchair comprises a lifting mechanism configured for displacing the main seat portion from a transport position to an elevated position allowing the bag frame to be mountable within the area configured for defecating the user such that the bag is ready for receiving excrements of the user; (b) placing the user onto the seat; (c) dismounting the auxiliary seat portion from the main seat portion; (d) displacing the main seat portion from a transport position to an elevated position; (e) mounting the bag frame and the disposable bag carried by the frame within the area configured for defecating the user; (f) dismounting the bag frame and the disposable bag after receiving the excrements thereinto; and (g) detaching the disposable bag from the bag frame.

According to a further embodiment of the present invention, the step of displacing main seat portion from a transport position to an elevated position performed by a lifting mechanism comprises a hydraulic system having a main cylinder actuated by an electric motor and at least two slave cylinders hydraulically connected to each other; the at least two slave cylinders manipulate the seat.

The invention claimed is:

1. A toilet wheelchair comprising:

a wheelchair frame;

at least three wheels rotatably connected to said wheelchair frame;

a seat carried by said wheelchair frame; said seat comprises a unitary main seat portion configured for carrying a user and an auxiliary seat portion releasably mountable in an area configured for defecating said user;

wherein said toilet wheelchair comprises a bag frame and a disposable bag carried by said frame; said toilet wheelchair comprises a lifting mechanism configured for displacing said main seat portion from a transport position to an elevated position allowing said bag frame to be mountable within said area configured for toileting said user such that said bag is ready for receiving excrements of said user wherein, said toilet wheelchair being in said transport position, said seat forms an integral comfortable seating surface further wherein said bag frame is releasably mountable in said area configured for defecating said user, said bag frame configured to replace said auxiliary seat portion during toileting.

2. The toilet wheelchair according to claim 1, wherein said lifting mechanism comprises a hydraulic system having a main cylinder actuated by an electric motor and at least two slave cylinders hydraulically connected to each other; said at least two slave cylinders manipulate said seat.

3. The toilet wheelchair according to claim 2, wherein said electric motor is energized by a rechargeable electric battery.

4. The toilet wheelchair according to claim 2, wherein said at least two slave cylinders are vertically oriented.

5. The toilet wheelchair according to claim 1, wherein bag frame is slidably insertable into said area configured for defecating said user.

6. A method of assisting user's toileting; said method comprising steps of:

providing a toilet wheelchair further comprising:

a wheelchair frame;

at least three wheels rotatably connected to said wheelchair frame;

a seat carried by said wheelchair frame; said seat comprises a unitary main seat portion configured for carrying a user and an auxiliary seat portion releasably mountable in an area configured for toileting said user;

said toilet wheelchair comprises a bag frame and a disposable bag carried by said frame; said toilet wheelchair comprises a lifting mechanism configured for displacing said main seat portion from a transport position to an elevated position allowing said bag frame to be mountable within said area configured for toileting said user such that said bag is ready for receiving excrements of said user;

placing said user onto said seat;

dismounting said auxiliary seat portion from said main seat portion;

displacing said main seat portion from said transport position to said elevated position;

mounting said bag frame and said disposable bag carried by said frame within said area configured for defecating said user;

dismounting said bag frame and said disposable bag after receiving said excrements thereinto; and detaching said disposable bag from said bag frame wherein, said toilet wheelchair being in said transport position, said seat forms an integral comfortable seating surface further wherein said bag frame is releasably mountable in said area configured for defecating said user, said bag frame configured to replace said auxiliary seat portion during toileting.

7. The method according to claim 6, wherein said step of displacing said main seat portion from said transport position to said elevated position is performed by a lifting mechanism comprising a hydraulic system having a main cylinder actuated by an electric motor and at least two slave cylinders hydraulically connected to each other; said at least two slave cylinders manipulate said seat.

8. The method according to claim 7, wherein said electric motor is energized by a rechargeable electric battery.

9. The method according to claim 7, wherein said at least two slave cylinders are vertically oriented.

10. The method according to claim 6, wherein said bag frame is slidably insertable into said area configured for defecating said user.

* * * * *